US006693260B1

(12) United States Patent
Rodrigues

(10) Patent No.: US 6,693,260 B1
(45) Date of Patent: Feb. 17, 2004

(54) WARMING APPARATUS

(75) Inventor: Robert Rodrigues, Raleigh, NC (US)

(73) Assignee: SpaCessories Inc., Raleigh, NC (US)

( * ) Notice: Subject to any disclaimer, the term of this patent is extended or adjusted under 35 U.S.C. 154(b) by 0 days.

(21) Appl. No.: 10/103,420

(22) Filed: Mar. 21, 2002

Related U.S. Application Data

(60) Provisional application No. 60/295,639, filed on Jun. 4, 2001.

(51) Int. Cl.[7] ..... F26B 9/10; F27D 7/04

(52) U.S. Cl. ..... 219/385; 219/386; 219/218; 219/201; 219/400; 312/236; 165/58

(58) Field of Search ..... 219/385, 386, 219/200, 201, 213, 218, 400; 165/58, 61, 64; 34/60, 224, 275; 62/3.6, 3.62, 3.2, 261; 312/236; 297/188.01–188.21

(56) References Cited

U.S. PATENT DOCUMENTS 1,752,797 A * 4/1930 Hutchinson ..... 219/400
3,111,166 A * 11/1963 Munz et al. ..... 62/3.6
3,670,425 A * 6/1972 Plichta ..... 307/127
3,733,836 A * 5/1973 Corini ..... 62/3.61
3,745,303 A * 7/1973 Epperson et al. ..... 219/218
3,805,561 A * 4/1974 Bullock ..... 34/517
4,644,136 A * 2/1987 Watchman ..... 219/400
4,849,610 A * 7/1989 Alvarez ..... 219/385
5,152,077 A * 10/1992 Liang ..... 34/225
5,301,508 A * 4/1994 Kahl et al. ..... 62/3.62
5,319,937 A * 6/1994 Fritsch et al.
5,369,892 A * 12/1994 Dhaemers ..... 34/275
5,569,403 A * 10/1996 Swanson et al. ..... 219/400
6,046,436 A * 4/2000 Hunts ..... 219/400
6,106,058 A * 8/2000 Sur et al. ..... 297/188.19
6,175,970 B1 1/2001 Pinciaro ..... 4/541.4
6,276,753 B1 * 8/2001 Sur et al. ..... 297/188.19
6,370,882 B1 * 4/2002 Adamski et al. ..... 62/3.6
6,484,512 B1 * 11/2002 Anderson et al. ..... 62/3.2

* cited by examiner

*Primary Examiner*—Joseph Pelham
(74) *Attorney, Agent, or Firm*—Winthrow & Terranova, PLLC

(57) ABSTRACT

The present invention relates to furniture, such as cabinets, benches with storage, and armoires, that include at least one chamber that is configured to heat, cool, or alternate between heating and cooling. As such, any or each chamber may be dedicated to heating or keeping items warm; dedicated to cooling or keeping items cool; or configured to heat and cool as desired. Multiple chambers may be provided in any one piece of furniture that are capable of such heating and cooling in any combination. The furniture may also include chambers for traditional storage without heating or cooling capability. The invention is preferably used outdoors for keeping garments and towels warm for swimmers and bathers when configured for heating. Cooling configurations and chambers may be used to keep food and beverages cool.

15 Claims, 6 Drawing Sheets

WARMING APPARATUS

This application claims the benefit of provisional patent application Ser. No. 60/295,639, filed Jun. 4, 2001, the disclosure of which is hereby incorporated by reference in its entirety.

FIELD OF THE INVENTION

The present invention relates to furniture, and particular to furniture capable of warming towels, clothes, robes, and like textiles, and optionally providing cooling capabilities for various types of food and beverages.

BACKGROUND OF THE INVENTION

Given the ever-increasing popularity of spas, homeowners are installing spas at their residences. Since spas are most frequently used during the colder months of the year, bathers are typically met with uncomfortably brisk surroundings upon leaving the spa. Since the bathers must dry off prior to reentering their homes, towels, robes, and the like are generally lain next to the spa while the bathers are in the spa and are used when the bathers leave the spa. Unfortunately, while the bathers are in the spa, the robes and towels settle to the cooler ambient temperatures, and tend to add to the chill associated with leaving the spa.

In an effort to minimize the chill of leaving the spa and using cold robes and towels, there is a need for a way to provide the bather with heated robes and towels upon exiting the spa. Preferably, the system for heating the robes and towels is aesthetically pleasing and capable of providing other features beneficial to the spa environment.

SUMMARY OF THE INVENTION

The present invention relates to furniture, such as cabinets, benches with storage, and armoires, that include at least one chamber that is configured to heat, cool, or alternate between heating and cooling. As such, any or each chamber may be dedicated to heating or keeping items warm; dedicated to cooling or keeping items cool; or configured to heat and cool as desired. Multiple chambers may be provided in any one piece of furniture that are capable of such heating and cooling in any combination. The furniture may also include chambers for traditional storage without heating or cooling capability. The invention is preferably used outdoors for keeping garments and towels warm for swimmers and bathers when configured for heating. Cooling configurations and chambers may be used to keep food and beverages cool.

Any type of heating device may be used for heating and is preferably associated with a thermostat to maintain desired temperatures. Automatic shut off circuitry may be used to turn systems off after a select amount of time or if certain thresholds are passed. Further, any type of refrigeration system may be used with a thermostat to control temperature. Any operational aspects may be remotely controlled. Any chamber, including those for heating and cooling, may include any combination of hooks, rods, shelves, and the like for holding, hanging, or otherwise storing towels, garments, and the like.

Those skilled in the art will appreciate the scope of the present invention and realize additional aspects thereof after reading the following detailed description of the preferred embodiments in association with the accompanying drawing figures.

BRIEF DESCRIPTION OF THE DRAWINGS FIGURES

The accompanying drawing figures incorporated in and forming a part of this specification illustrate several aspects of the invention, and together with the description serve to explain the principles of the invention.

DETAILED DESCRIPTION OF THE PREFERRED EMBODIMENTS

The embodiments set forth below represent the necessary information to enable those skilled in the art to practice the invention and illustrate the best mode of practicing the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

The present invention provides various types of furniture, including cabinets, benches, armoires, and the like, that have at least one chamber having the necessary equipment to heat, cool, or alternate between heating and cooling. The furniture may have multiple chambers providing heating, cooling, or a combination thereof, alone or in combination with chambers just for storage. The invention is particularly beneficial in outdoor furniture, wherein garments and towels are kept warm as bathers use a spa or swimming pool. Cooling capabilities may be used to keep food and beverages cool. Multiple embodiments are illustrated below.

Figure 1A:
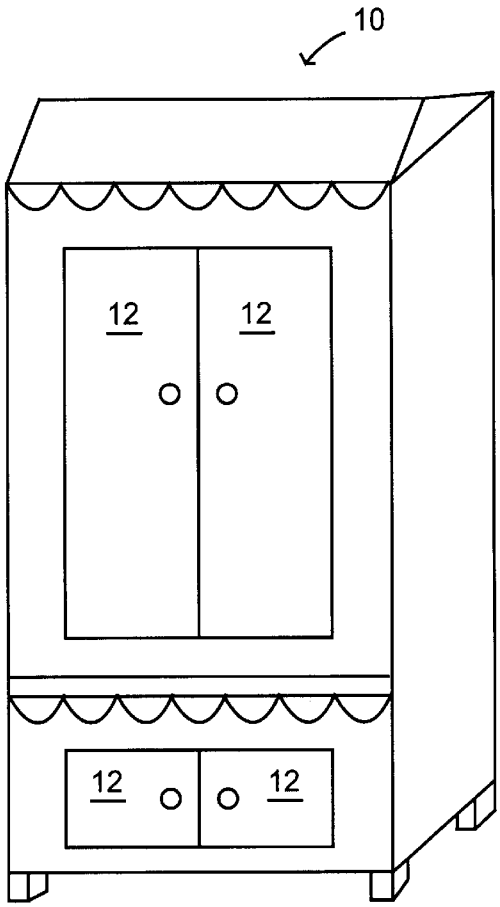
FIG. 1A is a perspective view of an armoire constructed according to one embodiment of the present invention.
Figure 1B:
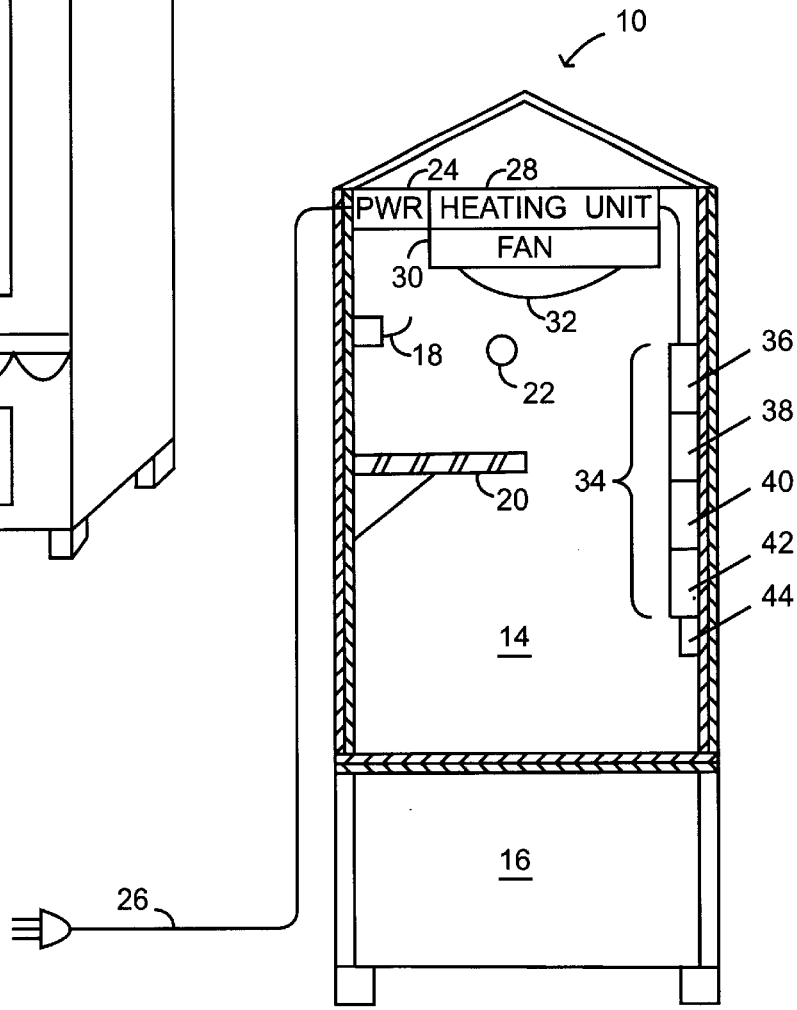
FIG. 1B is a cross-sectional view of the armoire of FIG. 1A.

With reference to FIGS. 1A and 1B, a cabinet 10, in the form of an armoire, includes multiple sets of doors 12, which lead to a warming compartment 14 and a basic storage compartment 16. The warming compartment 14 is shown having various apparatus for storing towels and garments, such as hangers 18, shelves 20, and rods 22. In addition to the doors 12, the cabinet 10 will include a frame and the necessary partitions, walls, and the like to form an enclosure.

The warming compartment 14 is preferably insulated, and includes a power supply 24 receiving power via a power cord 26. The power supply 24 provides power to a heating unit 28 and a fan 30 for circulating heat throughout the warming compartment 14. A light 32 may be provided for illumination of the warming compartment 14.

Preferably, a control system 34 provides overall control of the heating unit 28 and fan 30. In one embodiment, a switch 36 is operatively coupled to one or more of the doors 12 associated with the warming compartment 14 to detect the opening and closing of the doors 12. Further, an automatic shutoff 38 is associated with the control system 34 to turn off the heating unit 28 in case of overheating or like failure. A thermostat 40 is associated with the control system 34 or the heating unit 28 directly to allow the heating unit 28 to keep the warming compartment 14 at a desired temperature.

The control system 34 may be operatively coupled to remote control receiver electronics 42, which are further associated with a radio frequency or infrared sensor 44 to facilitate reception of remote commands. Accordingly, power control and heat settings may be provided in a remote fashion. In one embodiment, most of the electronics are mounted to or in the top or roof of the cabinet 10, and provide an integral roof capable of being inserted on top of the base of the cabinet 10. Preferably, the roof is of unitary construction with the electronics mounted thereto.

Figure 2A:
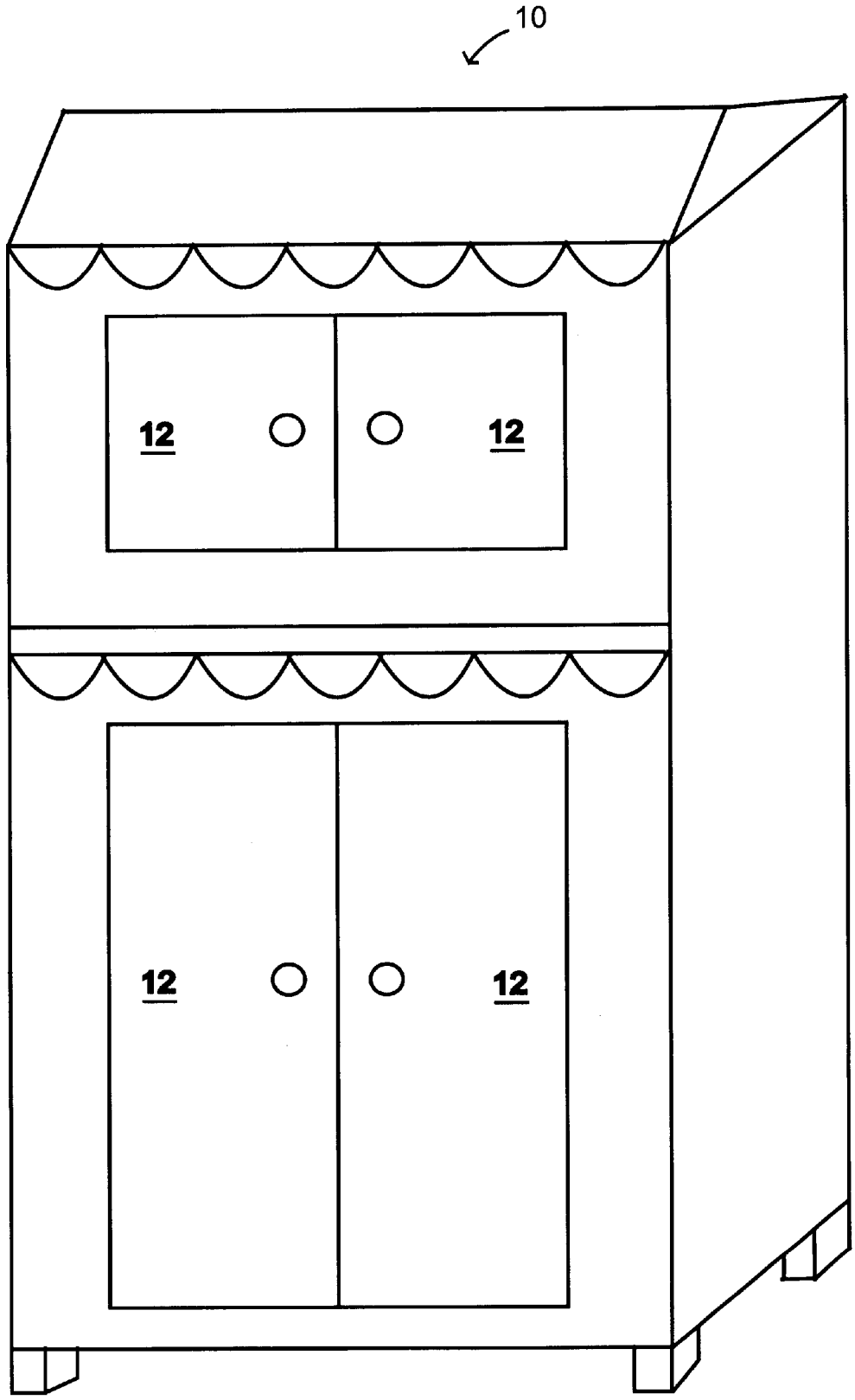
FIG. 2A is a perspective view of an armoire constructed according to a second embodiment of the present invention.
Figure 2B:
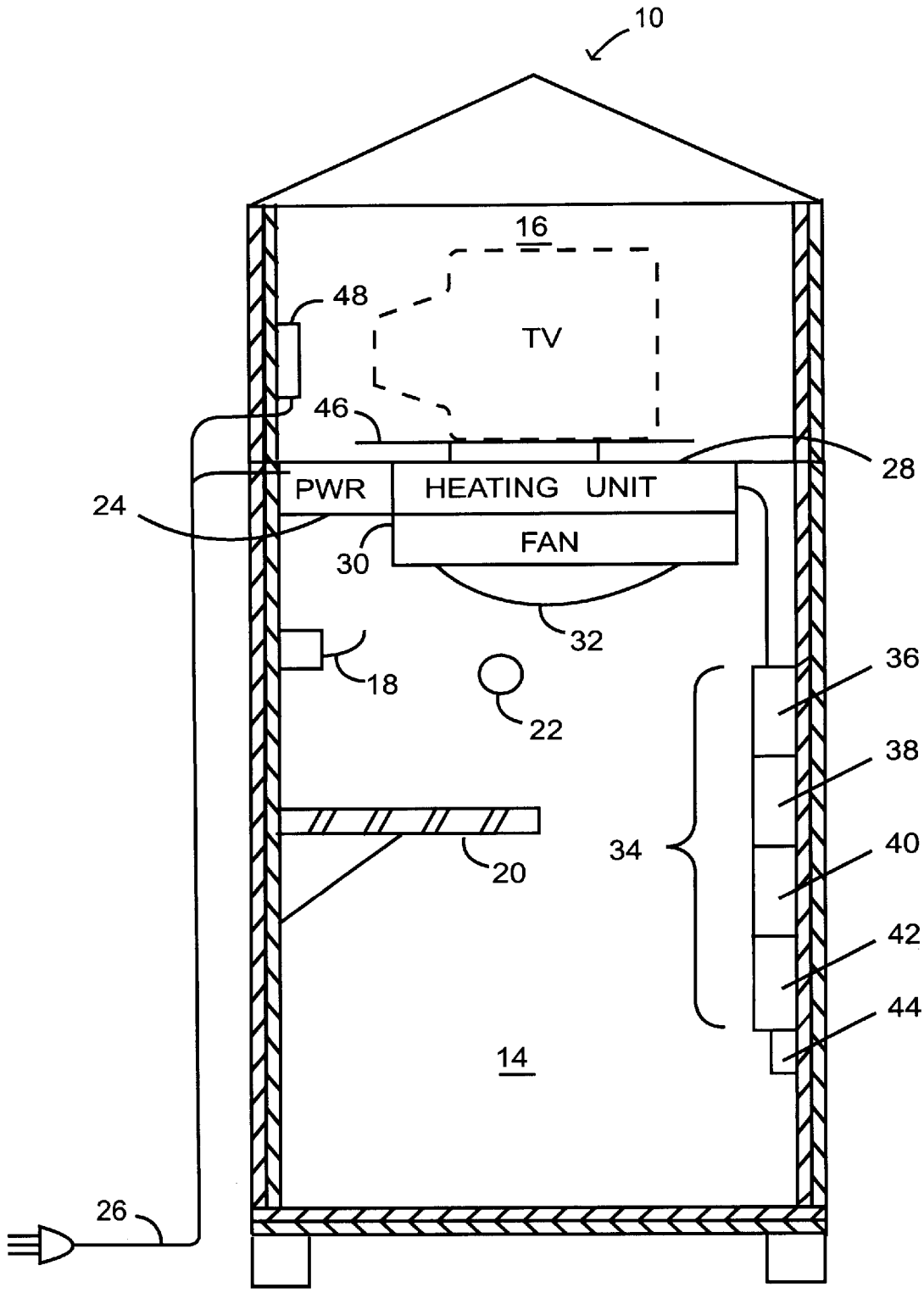
FIG. 2B is a cross-sectional view of the armoire of FIG. 2A.

Turning now to FIGS. 2A and 2B, an alternative cabinet is illustrated. The cabinet 10 includes the storage compartment 16 in an upper portion, which is configured to act as a television compartment. Accordingly, a television stand 46 is provided for a television, as well as a power strip and cable access module 48 to provide power and cable to a television. Notably, the warming compartment 14 is provided in the lower portion of the cabinet 10, which may include additional compartments for storage and the like.

Figure 3:
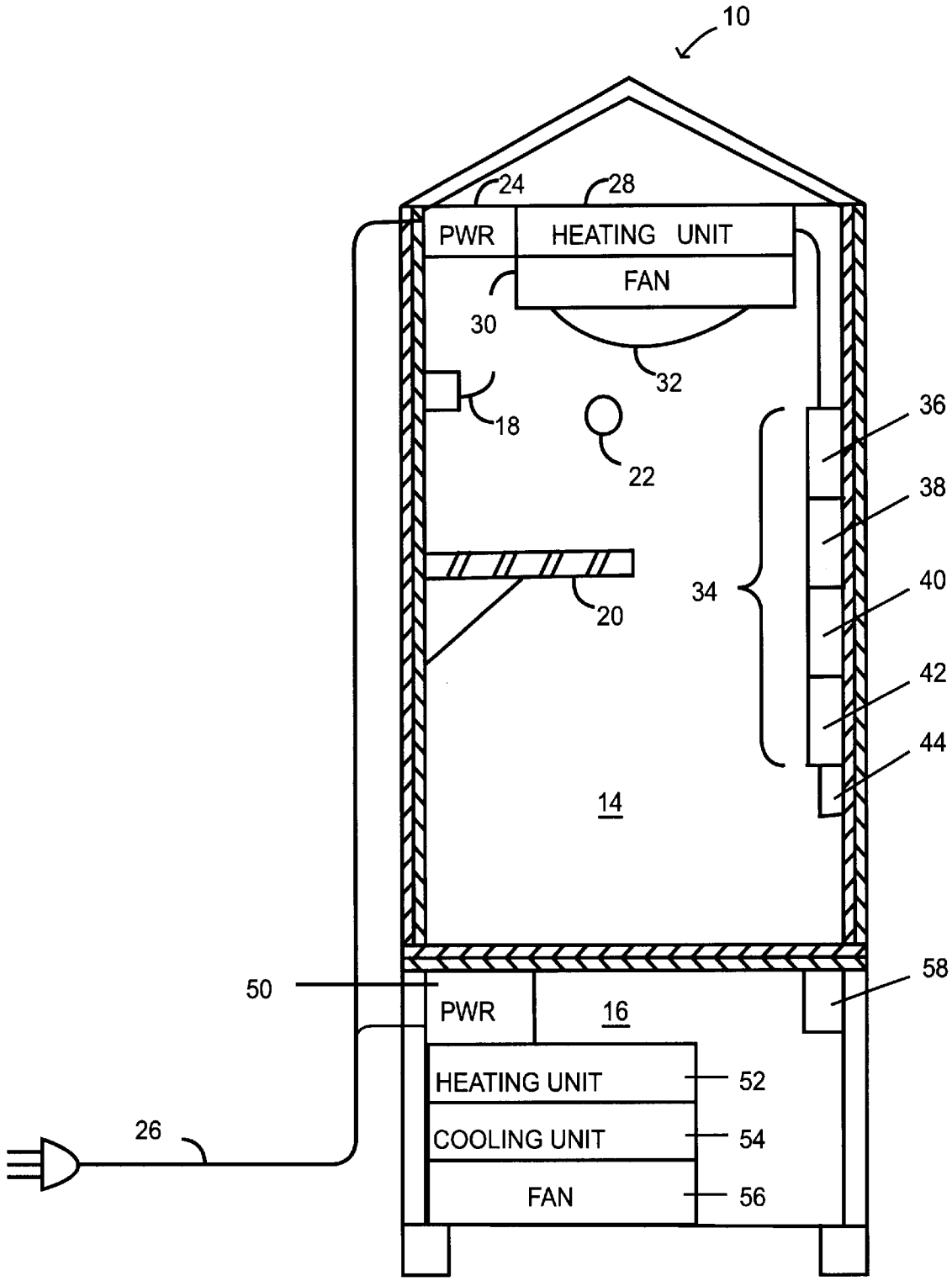
FIG. 3 is a cross-sectional view of an armoire according to a third embodiment of the present invention.

Yet another embodiment is illustrated in FIG. 3, wherein the storage compartment is insulated and configured for both heating and cooling Accordingly, a power supply 50 provides power to a heating unit 52 and a cooling until 54, which are both associated with a fan 56 for circulating heated or cooled air within the compartment 14. The heating and cooling units 52, 54 may be associated with a controlling unit 58, or may be controlled by the control system 34 in the warming compartment 14. Those skilled in the art will recognize the various techniques for equipping the cabinet 10 and the various compartments to heat, cool, or a combination thereof.

Figure 4A:
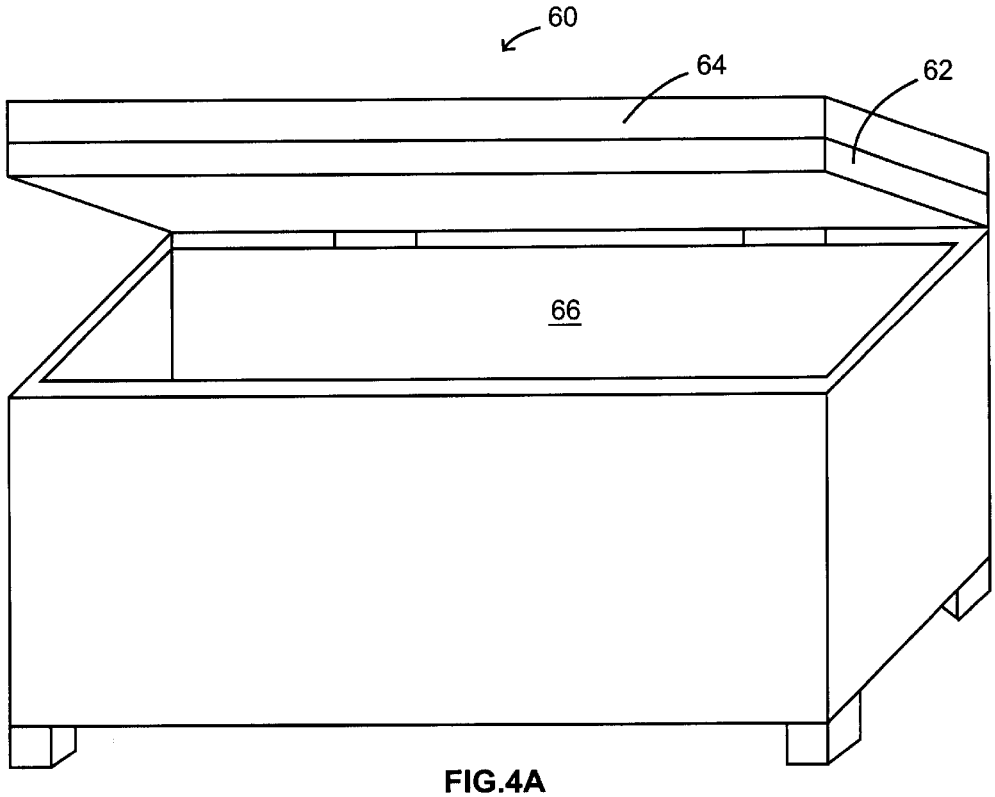
FIG. 4A is a perspective representation of a cabinet according to a fourth embodiment of the present invention.
Figure 4B:
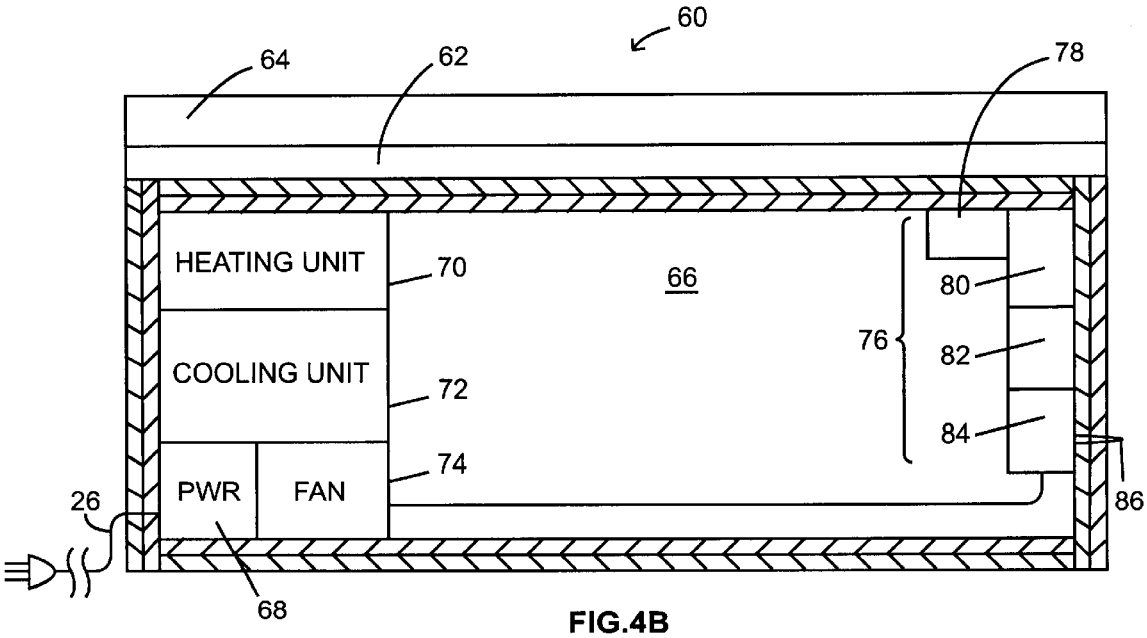
FIG. 4B is a cross-sectional view of the cabinet of FIG. 4A.

With reference to FIGS. 4A and 4B, a bench 60 is illustrated having a single lid 62 with a cushion 64 placed thereon. The bench 60 has a compartment 66, which may be heated or cooled. Accordingly, a power supply 68, which receives power through power cord 26, provides power to a heating unit 70 and a cooling unit 72, which are associated with a fan 74 for circulating air within the compartment 66.

A control system 76 is operatively associated with a switch 78, light 80, thermostat 82, and remote receiver electronics 84. Preferably, the switch 78 is associated with the lid 62 to allow the light 80 to turn on and off with the opening and closing of the lid 62. The thermostat 82 is operatively associated with the control system 76 or the heating and cooling units 70 and 72 directly to control the temperature of the compartment 66. The remote receiver electronics 84 are further associated with an infrared or radio frequency sensor 86 to facilitate remote control of the heating and cooling units 76 and 78 in a fashion similar to that described above.

Figure 5A:
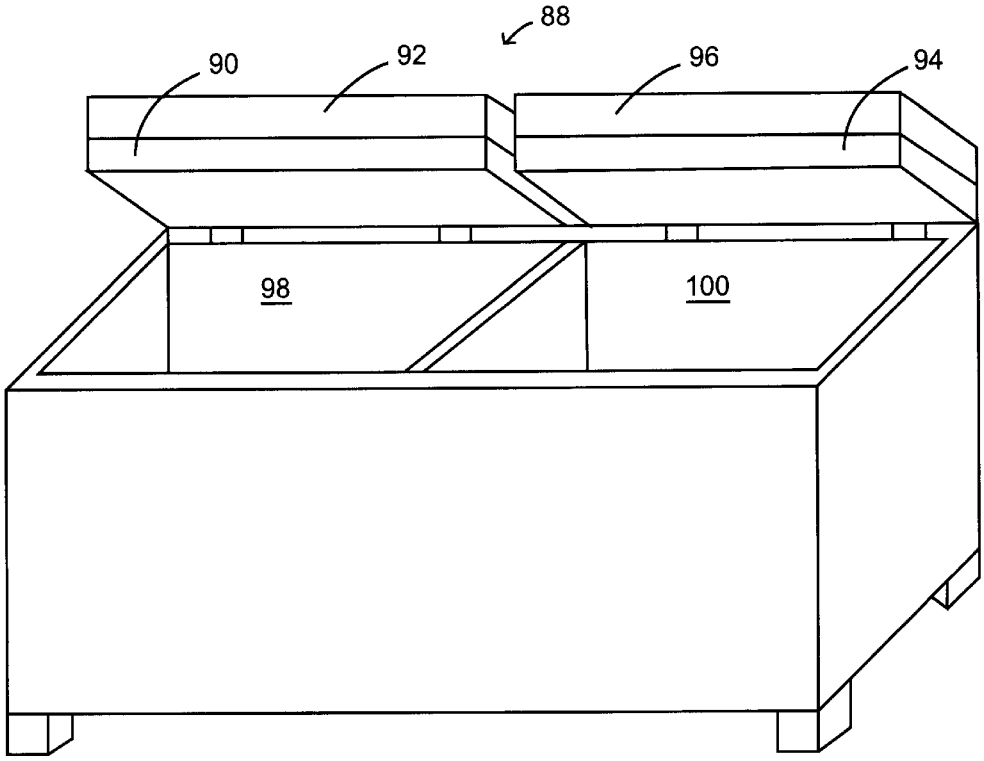
FIG. 5A is a perspective representation of a cabinet according to a fifth embodiment of the present invention.
Figure 5B:
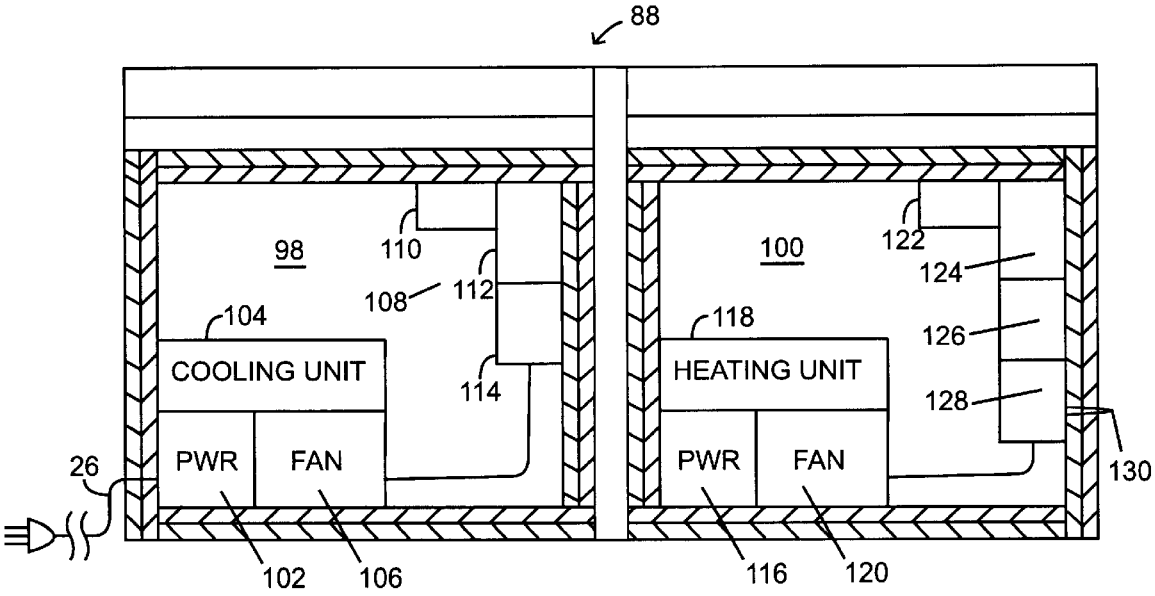
FIG. 5B is a cross-sectional view of the cabinet of FIG. 5A.

With reference to FIGS. 5A and 5B, a bench 88 is shown with a first lid 90 having a first cushion 92, and a second lid 94 having a second cushion 96, which provide access to a cooling compartment 98 and a heating compartment 100, respectively. Again, the heating and cooling compartments 98, 100 in are preferably insulated. The cooling compartment 98 may include a power supply 102 associated with a cooling unit 104 and fan 106 for circulating air within the cooling compartment 98. A control system 108 is used to provide control of the cooling unit 104, and may also be associated with a switch 110 and a light 112 for controlling illumination of the cooling compartment 98 when the lid 90 is opened and closed. Again, a thermostat 114 may be associated with the cooling unit 104 or control system 108 to control the temperature of the cooling compartment 98.

Similarly, the heating compartment 100 will include a power supply 116 for providing power to a heating unit 118, which may be associated with a fan 120 for circulating air within the heating compartment 100. A control system 122 may be associated with the heating unit 118, as well as with a light 124 and switch (not shown), which could be associated with the lid 94. A thermostat 126 is provided for controlling the temperature within the heating compartment 100. Receiver electronics 128, which are associated with an infrared or radio frequency sensor 130, may be coupled to the control system 122 as well as the control system 108 for the cooling compartment 98 to provide remote control of the heating, cooling, and lighting within the compartments 98, 100, if so desired. Preferably, both the cooling compartment 98 and the heating compartment 100 are insulated.

In summary, the present invention relates to furniture, such as cabinets, benches with storage, and armoires, that include at least one chamber that is configured to heat, cool, or alternate between heating and cooling. As such, any or each chamber may be dedicated to heating or keeping items warm; dedicated to cooling or keeping items cool; or configured to heat and cool as desired. Multiple chambers may be provided in any one piece of furniture that are capable of such heating and cooling in any combination. The furniture may also include chambers for traditional storage without heating or cooling capability. The invention is preferably used outdoors for keeping garments and towels warm for swimmers and bathers when configured for heating. Cooling configurations and chambers may be used to keep food and beverages cool.

Any type of heating device may be used for heating and is preferably associated with a thermostat to maintain desired temperatures. Automatic shut off circuitry may be used to turn systems off after a select amount of time or if certain thresholds are passed. Further, any type of refrigeration system may be used with a thermostat to control temperature. Any chamber, including those for heating and cooling, may include any combination of hooks, rods, shelves, and the like for holding, hanging, or otherwise storing towels, garments, and the like.

The control for any of the above embodiments may be integrated in a variety of ways. For example, an integrated control panel may be configured to mount in a drawer or behind a door an include any one or more of the components being controlled. Preferably, temperature is controlled over time with the control panel. For example, a timer and a desired temperature may be set at the control panel for a heating or cooling compartment, such that the compartment with heat or cool to a desired temperature and maintain the desired temperature for a set amount of time. In one embodiment, the control panel includes a display, which is viewable from the outside of the cabinet and displays the current compartment temperature, the desired compartment temperature, and the time remaining on the timer in a static or cyclic fashion. The desired temperature, timer, and display modes may be controlled remotely.

The materials used to make the cabinet may range from metal and wood to various polymers, which are preferably weather-resistant. Further, although the furniture is beneficial for outdoor use, the functionality of the furniture is also beneficial indoors, especially in bathrooms.

Those skilled in the art will recognize improvements and modifications to the preferred embodiments of the present invention. All such improvements and modifications are considered within the scope of the concepts disclosed herein and the claims that follow.

What is claimed is:

1. An apparatus comprising:

a furniture housing forming:

at least one compartment operatively associated with a heating unit and a control system for controlling the heating unit; and a storage compartment, wherein the at least one compartment is capable of warming textiles placed therein and the furniture housing forms an armoire with the at least one compartment.

2. The apparatus of claim 1 further comprising a roof operatively attached to a top of the housing.

3. The apparatus of claim 2 wherein the control system and heating unit are integrally attached to the roof.

4. The apparatus of claim 1 further comprising means for holding the textiles, the means for holding attached to an inside wall of the at least one compartment.

5. The apparatus of claim 4 wherein the means for holding is a hook.

6. The apparatus of claim 4 wherein the means for holding is a shelf.

7. The apparatus of claim 4 wherein the means for holding is a rod.

8. The apparatus of claim 1 further comprising a cooling unit associated with the at least one compartment wherein the heating unit and the cooling unit operate to either heat or cool the at least one compartment.

9. The apparatus of claim 1 wherein the heating unit and control system are associated with a remote receiving electronics and a receiver to facilitate remote control of the heating unit.

10. The apparatus of claim 1 wherein the furniture housing is made of a weather resistant material conducive to outdoor use.

11. An apparatus comprising:

a furniture housing forming:

at least one compartment operatively associated with a heating unit and a control system for controlling the heating unit; and a cooling compartment, wherein the at least one compartment is capable of warming textiles placed therein.

12. The apparatus of claim 11 further comprising a cooling unit associated with the cooling compartment.

13. An apparatus comprising a furniture housing forming an armoire comprising first and second compartments, the first compartment being insulated and comprising a heating unit and control system for controlling the heating unit wherein the at least one compartment is capable of warming textiles placed therein, the second compartment being insulated and comprises a cooling unit.

14. The apparatus of claim 13 further comprising a roof operatively attached to a top of the furniture housing.

15. The apparatus of claim 14 wherein the control system and heating unit are integrally attached to the roof.

* * * * *